US011011333B2

(12) United States Patent
Leipold et al.

(10) Patent No.: US 11,011,333 B2
(45) Date of Patent: May 18, 2021

(54) FORCE-DISTANCE CONTROLLED MECHANICAL SWITCH

(71) Applicant: Rohde & Schwarz GmbH & Co. KG, Munich (DE)

(72) Inventors: Markus Leipold, Isen (DE); Sebastian Sedlmeier, Munich (DE); Martin Lasinger, Sauerlach (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 53 days.

(21) Appl. No.: 16/528,766

(22) Filed: Aug. 1, 2019

(65) Prior Publication Data

US 2021/0035758 A1 Feb. 4, 2021

(51) Int. Cl.

| | |
|---|---|
| ***H01H 50/30*** | (2006.01) |
| ***H01P 1/22*** | (2006.01) |
| *H01H 51/27* | (2006.01) |

(52) U.S. Cl.

CPC ..... *H01H 50/30* (2013.01); *H01P 1/227* (2013.01); *H01H 51/27* (2013.01); *H01H 2221/062* (2013.01); *H01H 2235/00* (2013.01)

(58) Field of Classification Search

CPC .. H01P 1/127; H01P 1/122; H01P 1/10; H01P 1/222; H01P 1/227; H01P 1/22; H01P 1/12; H01H 3/12; H01H 3/02; H01H 2003/0253; H01H 2003/0266; H01H 50/30; H01H 50/305; H01H 51/27; H01H 51/28; H01H 2221/062

USPC ..... 333/81 B, 81 R, 81 A, 262, 259, 258

See application file for complete search history.

(56) References Cited

U.S. PATENT DOCUMENTS

| | | | | |
|---|---|---|---|---|
| 4,070,637 | A | 1/1978 | Assal et al. | |
| 4,304,973 | A * | 12/1981 | Fenelle | H01H 13/702 200/330 |
| 4,829,947 | A | 5/1989 | Lequesne | |
| 4,831,222 | A | 5/1989 | Grellmann et al. | |
| 5,202,658 | A | 4/1993 | Everett et al. | |
| 5,814,907 | A | 9/1998 | Bandera | |
| 5,815,057 | A | 9/1998 | Hoffman et al. | |
| 6,005,459 | A | 12/1999 | Hoffman | |
| 6,650,210 | B1 | 11/2003 | Raklyar et al. | |
| 7,021,603 | B2 | 4/2006 | Wygnaski | |
| 7,078,832 | B2 | 7/2006 | Inagaki et al. | |
| 7,489,179 | B2 | 2/2009 | Kraemer | |
| 7,633,361 | B2 | 12/2009 | Raklyar et al. | |
| 7,843,289 | B1 | 11/2010 | Raklyar et al. | |
| 7,876,185 | B2 | 1/2011 | Trinh et al. | |
| 7,898,122 | B2 | 3/2011 | Andrieux et al. | |
| 10,090,128 | B2 | 10/2018 | Sterns et al. | |
| 10,141,146 | B2 | 11/2018 | Sterns et al. | |
| 10,193,202 | B2 | 1/2019 | Sterns et al. | |
| 2003/0020561 | A1 | 1/2003 | Qiu et al. | |
| 2009/0273420 | A1 | 11/2009 | Trinh et al. | |
| 2018/0145387 | A1 * | 5/2018 | Sterns | H01P 1/12 |

* cited by examiner

*Primary Examiner* — Stephen E. Jones

(74) *Attorney, Agent, or Firm* — Potomac Technology Law, LLC

(57) ABSTRACT

A force-controlled-switch comprises a diaphragm spring element and an absorber-plate. The absorber-plate is configured to absorb kinetic energy of the force-controlled-switch. In particular, the absorber-plate absorbs a part of the diaphragm-spring-element's kinetic energy.

14 Claims, 17 Drawing Sheets

FORCE-DISTANCE CONTROLLED MECHANICAL SWITCH

TECHNICAL FIELD

The invention relates to a switch for switching a switching conductor between two positions and a respective radio frequency relay and step attenuator.

BACKGROUND

In recent years, a trend within communications electronics towards ever increasing frequencies is noticeable. Measurement equipment for measuring high frequency signals is therefore necessary. Within such measurement equipment, it is necessary to be able to switch such high frequency signals in a controlled manner without influencing the high frequency signal significantly.

For example, U.S. Pat. No. 10,141,146 B1 shows a mechanical switch for steering a radio-frequency signal. Those switches, however, possess some switch bouncing characteristics and might negatively influence the termination during switching.

Accordingly, there is a need to provide a switch for switching radio-frequency signals, which avoids the contact bouncing during the change of the state.

SUMMARY

Embodiments of the present invention advantageously address the foregoing requirements and needs, as well as others, by providing a switch for switching radio-frequency signals, which avoids the contact bouncing during the change of the state.

According to a first aspect of the invention, a force-controlled-switch is provided. The force-controlled-switch comprises a diaphragm spring element and an absorber-plate. The absorber-plate is configured to absorb kinetic energy of the force-controlled-switch, in particular a part of the diaphragm-spring-element's kinetic energy.

According to a first preferred implementation from the first aspect, the absorber-plate is arranged in plane contact to the diaphragm-spring-element. Advantageously, the arrangement of the absorber-plate in contact to the diaphragm-spring-element allows a significant damping of undesired movement caused by kinetic energy.

According to a second preferred implementation from the first aspect, the diaphragm-spring-element and the absorber-plate form a sandwich. Advantageously, the sandwich configuration of the diaphragm-spring-element and the absorber-plate allow a simplified assembly of the force-controlled-switch.

According to a further preferred implementation from the first aspect, the absorber-plate comprises at least one slot. Advantageously, the slot within the absorber-plate allows a uniform deformation of the absorber-plate. The uniform deformation of the absorber-plate leads to an enhanced damping of the undesired movement of the diaphragm-spring-element.

According to a further preferred implementation from the first aspect, the absorber-plate is formed of a friction stable material, preferably of Polyimide or PTFE. Advantageously, the material of the absorber-plate being friction stable results in an enhanced lifetime of the diaphragm-spring-element and the absorber-plate. Additionally, using Polyimide or PTFE results in an improved dimensional stability under heat.

According to a further preferred implementation from the first aspect, the diaphragm-spring-element is a circular shaped plate comprising at least one helical-spring-recess. This allows for a simple and low-cost construction.

According to a further preferred implementation from the first aspect, the surface of the absorber-plate is equal or greater than the outer dimension of the helical-spring-recess. Advantageously, the abovementioned dimension of the absorber-plate prevents an interlock of the absorber-plate within the recesses of the diaphragm-spring.

According to a further preferred implementation from the first aspect, the absorber-plate has a thickness of 0.1-1 mm, preferably of 0.4-0.7 mm. This allows a compact construction of the force-controlled-switch.

According to a further preferred implementation from the first aspect, the force-controlled-switch comprises an additional stop-member. Advantageously, the stop-member prevents the diaphragm-spring-element from overshooting in a direction averted to the absorber-plate. Furthermore, the stop-member enhances the switching time of the force-controlled-switch.

According to a further preferred implementation form of the first aspect, the stop-member is formed of a rigid material, preferably of metal or fiber-reinforced-plastic.

According to a further preferred implementation form of the first aspect, the stop-member has a thickness of 0.3-1 mm, preferably 0.5-0.8 mm.

According to a second aspect of the invention, a radio-frequency-relays is provided. The radio-frequency-relays comprises at least one force-controlled-switch according to one implementation form of the first aspect. A first conductor of the force-controlled-switch forms an input-terminal of the radio-frequency-relays. A second conductor of the force-controlled-switch forms an output-terminal of the radio-frequency-relays.

According to a third aspect of the invention, a step-attenuator is provided. The switchable attenuator comprises at least two force-controlled-switches according to one implementation form of the first aspect of the invention. A first conductor of the first force-controlled-switch element forms an input terminal of the step attenuator. A first conductor of the second force-controlled-switch element forms an output terminal of the step-attenuator or an input-terminal of a further force-controlled-switch element according to one implementation form of the first aspect of the invention. A second conductor of a first force-controlled-switch element of the at least two force-controlled-switch elements according to one implementation form of the first aspect of the invention is connected to a first terminal of an electrical element. A second conductor of a second force-controlled-switch element of the at least two force-controlled-switch elements according to one implementation form of the first aspect of the invention is connected to a second terminal of the electrical element. A third conductor of the first force-controlled-switch element is connected to a third conductor of the second force-controlled-switch element to one implementation form of the first aspect of the invention. This allows for a very small footprint construction of a step attenuator usable at very high frequencies with enhanced set time.

According to a fourth aspect of the invention, a selector switch is provided, which comprises a force-controlled-switch according to one implementation form of the first aspect of the invention. A first conductor of the force-controlled-switch element according to one implementation form of the first aspect of the invention is connected to a first terminal. A second conductor of the force-controlled-switch element according to one implementation form of the first aspect of the invention is connected to a second terminal. A third conductor of the force-controlled-switch element according to one implementation form of the first aspect of the invention is connected to a third terminal. A very simple construction of a selector switch with enhanced set-time and reset-time usable at very high frequencies is thereby possible.

BRIEF DESCRIPTION OF THE DRAWINGS

An exemplary embodiment of the invention is now further explained by way of example only with respect to the drawings, in which.

DETAILED DESCRIPTION

Figure 1:
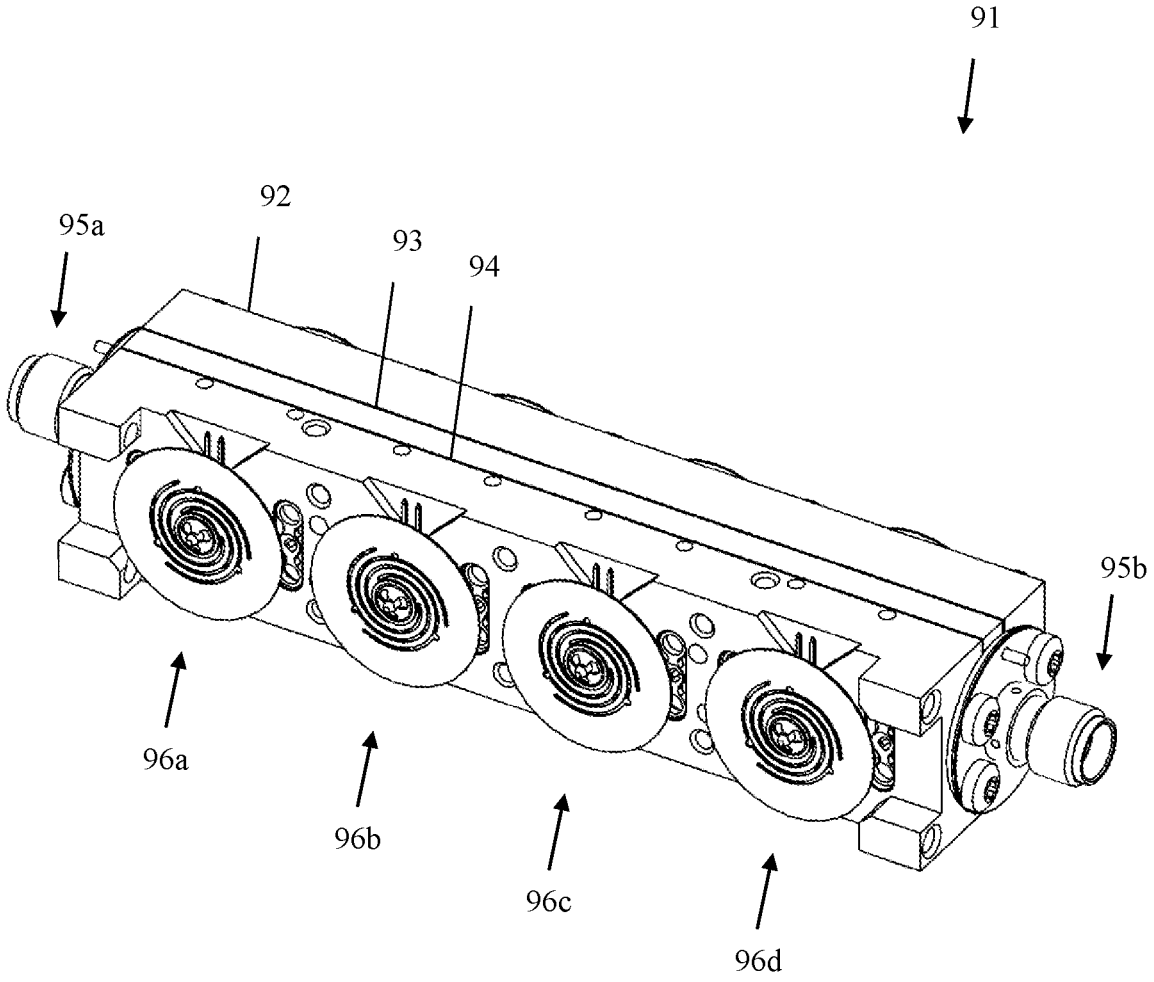
Fig. 1 (Prior Art)
FIG. 1 shows a state of the art step attenuator.

In FIG. 1, a state of the art step attenuator is depicted. We demonstrate the general construction of a multi-stage step attenuator along FIG. 2-6. Along FIG. 7-8, details of the conductors within the step attenuator are shown. In FIG. 9, the construction of an electrical element within the step attenuator is depicted. In FIG. 10-13, details of the construction of a switching conductor and surrounding elements is shown. With regard to FIG. 14-15, the construction of an exemplary selector switch is shown. Along FIG. 16-18, the construction and function of an according switching actuator is shown. Similar entities and reference numbers in different figures have been partially omitted.

Reference will now be made in detail to the preferred embodiments of the present invention, examples of which are illustrated in the accompanying drawings. However, the following embodiments of the present invention may be variously modified and the range of the present invention is not limited by the following embodiments.

In FIG. 1, a state of the art switchable attenuator according to U.S. Pat. No. 10,141,146 B1, here also called step attenuator 91 is shown. The step attenuator 91 has an input port 95*a* and an output port 95*b*. The step attenuator 91 is comprised of a lower housing 92, a baseplate 93 and an upper housing 94. The lower housing 92 and the upper housing 94 sandwich the baseplate 93. Moreover, the step attenuator 91 comprises a number of attenuation stages, which are not separately depicted here. The attenuation stages are arranged between the input port 5*a* and the output port 95*b*. Each attenuation stage has an actuator 96*a*, 96*b*, 96*c*, 96*d*. With each of the actuators 96*a*-96*d*, it is possible to switch an electrical element, for example a resistor into the signal path between the input port 95*a* and the output port 95*b*.

Figure 2:
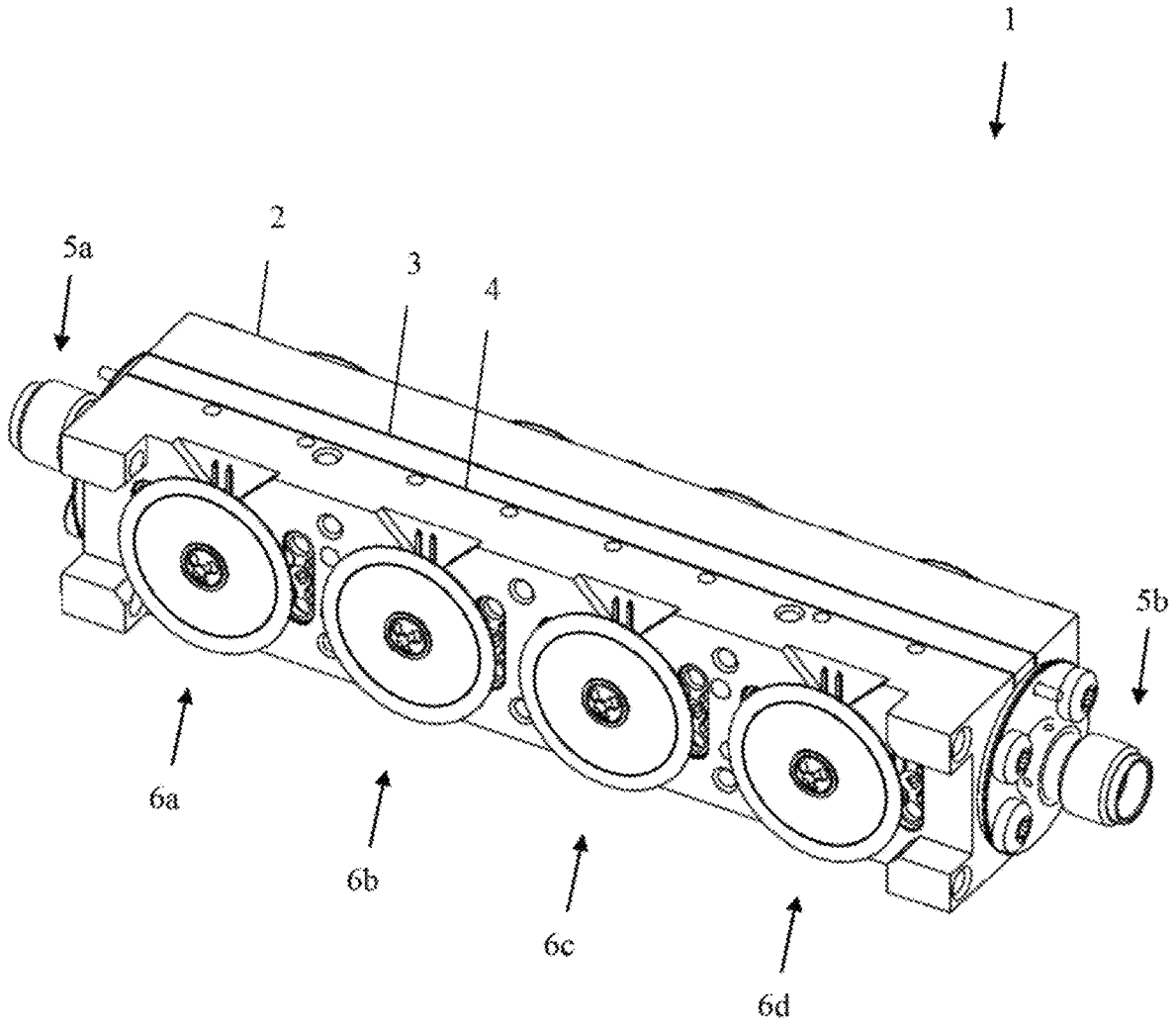
FIG. 2 shows an example step attenuator according to an example embodiment of the present invention.

In FIG. 2, a step attenuator 1, according to the first aspect of the invention is shown. The step attenuator 1 has an input port 5*a* and an output port 5*b*. The step attenuator 1 is comprised of a lower housing 2, a baseplate 3 and an upper housing 4. The lower housing 2 and the upper housing 4 sandwich the baseplate 3. Moreover, the step attenuator 1 comprises a number of attenuation stages, which are not separately depicted here. The attenuation stages are arranged between the input port 5*a* and the output port 5*b*. Each attenuation stage has an actuator 6*a*, 6*b*, 6*c*, 6*d*. With each of the actuators 6*a*-6*d* with the inventive absorber plates, it is possible to switch an electrical element, for example a resistor into the signal path between the input port 5*a* and the output port 5*b*.

Figure 3:
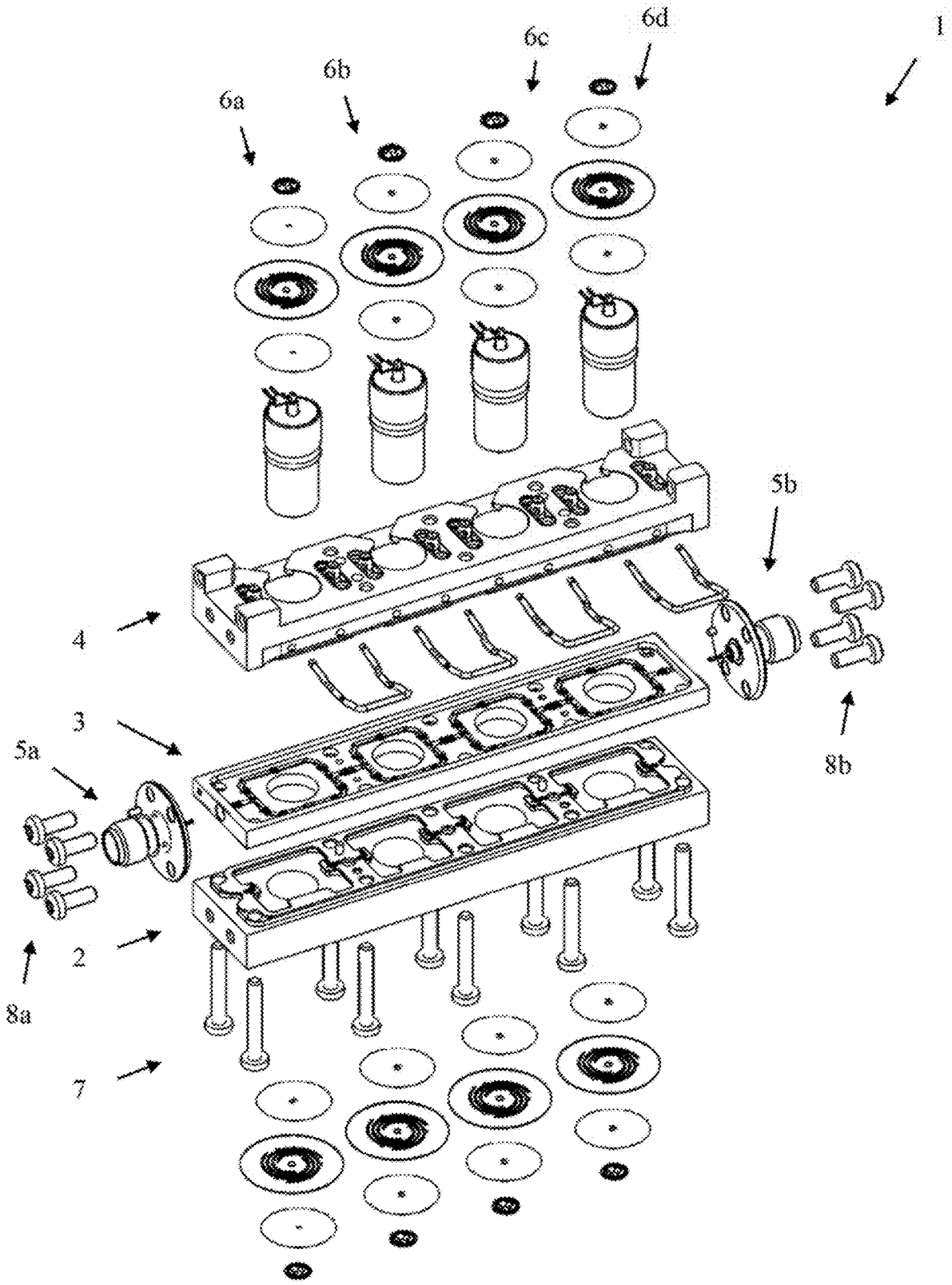
FIG. 3 shows an explosion view of a second embodiment of the step attenuator according to an example embodiment of the present invention.

In FIG. 3, an explosion view of the step attenuator 1 of FIG. 2 is shown. It can clearly be seen here that the input port 5*a* is held in place by bolts 8*a*, which screw into the upper housing 4 and the lower housing 2. Also, the output port 5*b* is held in place by bolts 8*b*, which also screw into the upper housing 4 and the lower housing 2. The upper housing 4, the baseplate 3 and the lower housing 2 are moreover held together by bolts 7.

Further details of the individual elements will be given in the further figures.

Figure 4:
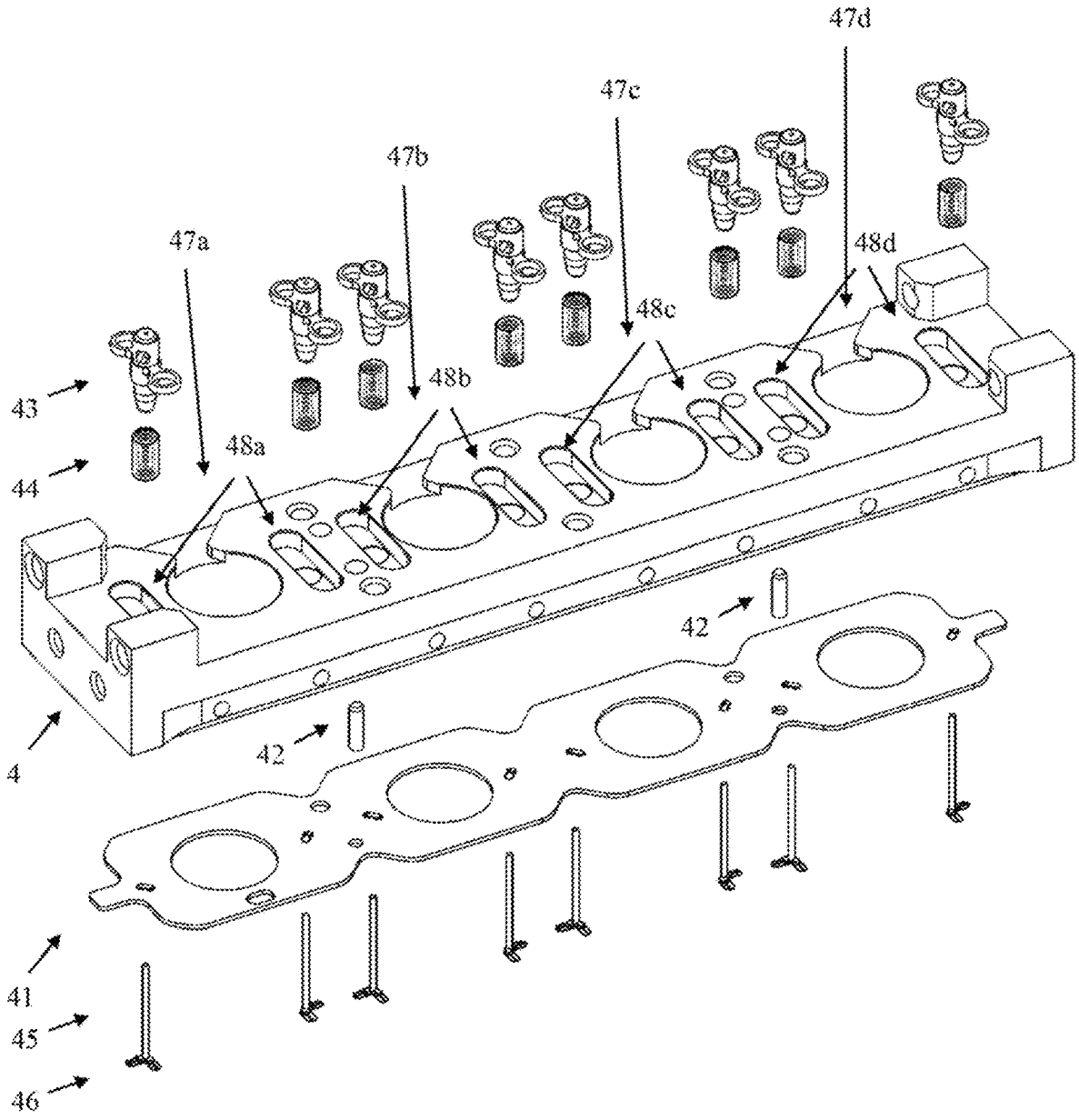
FIG. 4 shows an explosion view of an upper housing of the step attenuator according to an example embodiment of the present invention.

In FIG. 4, a detailed view of the upper housing 4 and surrounding components is given. The upper housing 4 comprises a number of holes 47*a*, 47*b*, 47*c*, 47*d*, which are configured for passing an actuator 6*a*-6*d* through. Moreover, the upper housing 4 comprises additional holes 48*a*, 48*b*, 48*c*, 48*d* for passing through connecting rods 45, which are attached to switching conductors 46 on their lower side and shafts 43 on their upper side. Between the respective shaft 43 and the upper housing 4, additionally a respective spring 44 is arranged, holding the connecting rod 45 and the attached shaft 43 under tension. Below the upper housing 4, a high frequency sealing sheet 41 is arranged. Bolts 42 keep the upper housing 4, the sealing sheet 41 and the baseplate 3 aligned.

Figure 5:
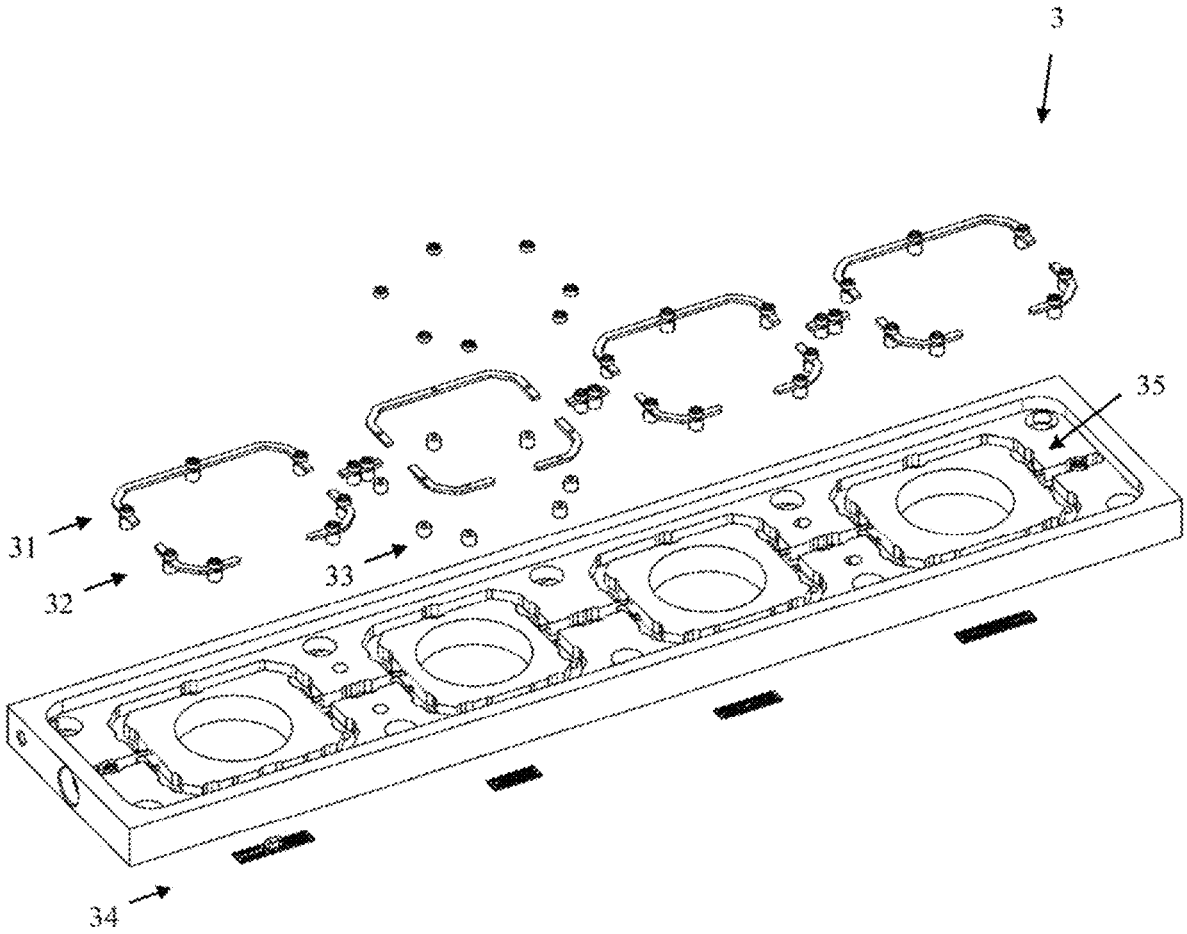
FIG. 5 shows an explosion view of a baseplate of the step attenuator according to an example embodiment of the present invention.

In FIG. 5, a detailed view of the baseplate 3 is shown. The baseplate 3 comprises a strip conductor channel 35, which connects the input port side and the output port side of the baseplate 3. For each of the attenuation stages of the step attenuator 1, the strip conductor channel 35 forms two paths, one path for a through connection and one path for a connection with an electrical element 34. Within the strip conductor channel 35 strip conductors 31 and 32 are arranged. The strip conductor 31 forms the respective through connection in each of the attenuation stages. The strip conductor 32 connects the electrical element 34 of the respective stage. Within each of the attenuation stages, switches on an input side and on an output side, switch either the strip conductor 31 or the strip conductor 32 into the signal path between the input port and the output port.

The strip conductors 31, 32 are held in place by axially symmetric non-conductive support elements 33.

The strip conductor channel 35 has a conductive surface. Especially, the strip conductor channel 35 is machined into the baseplate 3, which is formed from solid metal. Since the support elements 33 hold the strip conductors 31, 32 with a gap towards the strip conductor channel 35, there is no conductive connection between the strip conductors 31, 32 and the strip conductor channel 35. Also, there is no conductive connection between the electrical elements 34 and the strip conductor channel. It is important though, that there is a good thermal coupling between the electrical elements 34 and the strip conductor channel and therefore the baseplate 3, so that signal power can be dissipated.

Figure 6:
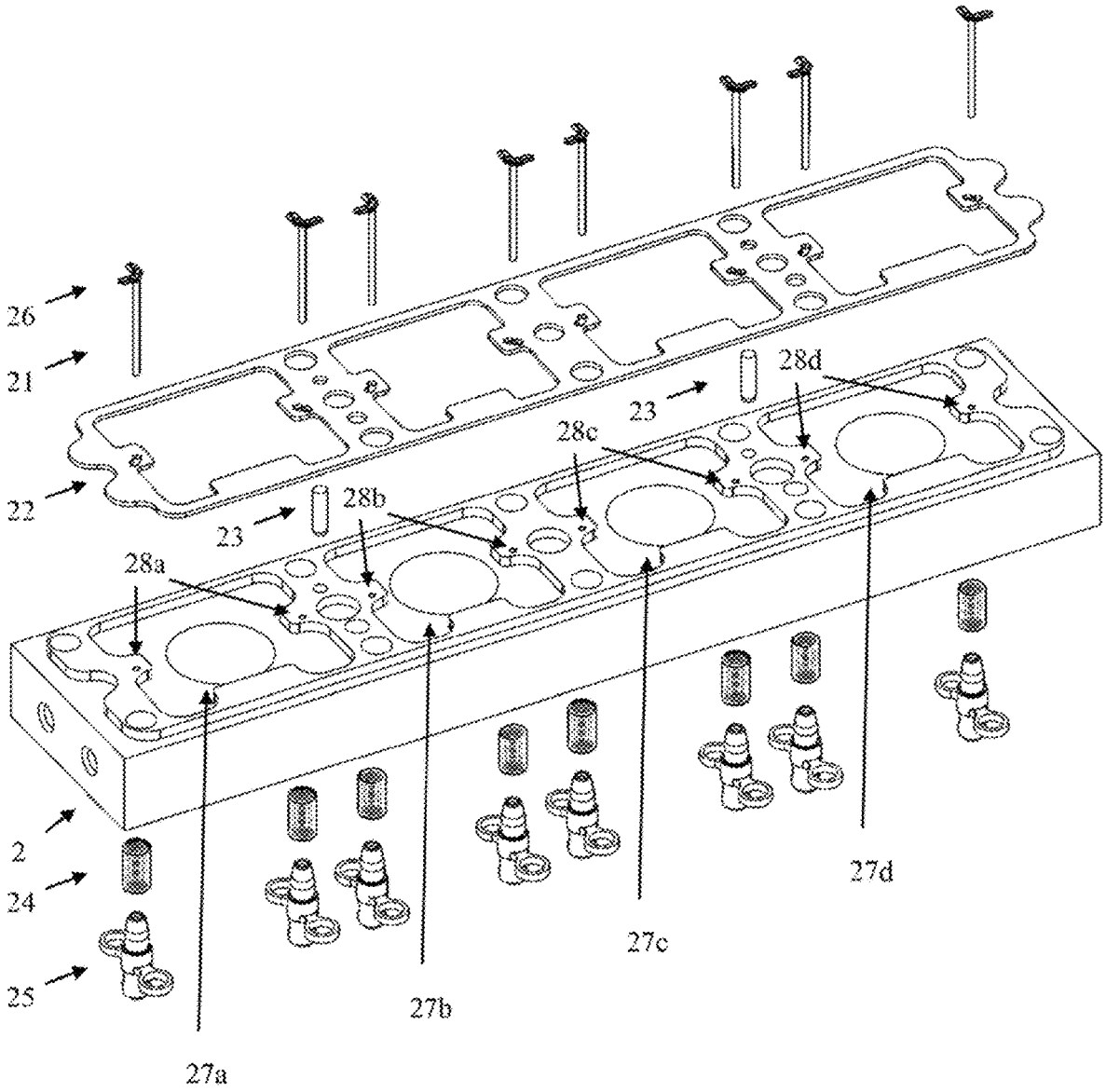
FIG. 6 shows an explosion view of a lower housing of the step attenuator according to an example embodiment of the present invention.

In FIG. 6, a detailed view of the lower housing 2 is shown. Also here, a high frequency sealing sheet 22 is arranged between the lower housing 2 and the baseplate 3. Bolts 23 hold the lower housing 2, the high frequency sealing sheet 22 and the baseplate 3 aligned. The lower housing 2 comprises a number of holes 27*a*, 27*b*, 27*c* and 27*d* for passing an actuator 6*a*-6*d* through. Moreover, the lower housing 2 as well as the high frequency sealing sheet 22 comprise additional holes 28*a*, 28*b*, 28*c* and 28*d* for passing connecting rods 21 through. The connecting rods 21 are attached to switching conductor 26 on the upper side and to shafts 25 on the lower side. Between the lower housing and the respective shaft 25, for each connecting rod 21, a spring 24 is arranged, holding the shafts and the connecting rods at tension with regard to the lower housing 2.

Figure 7:
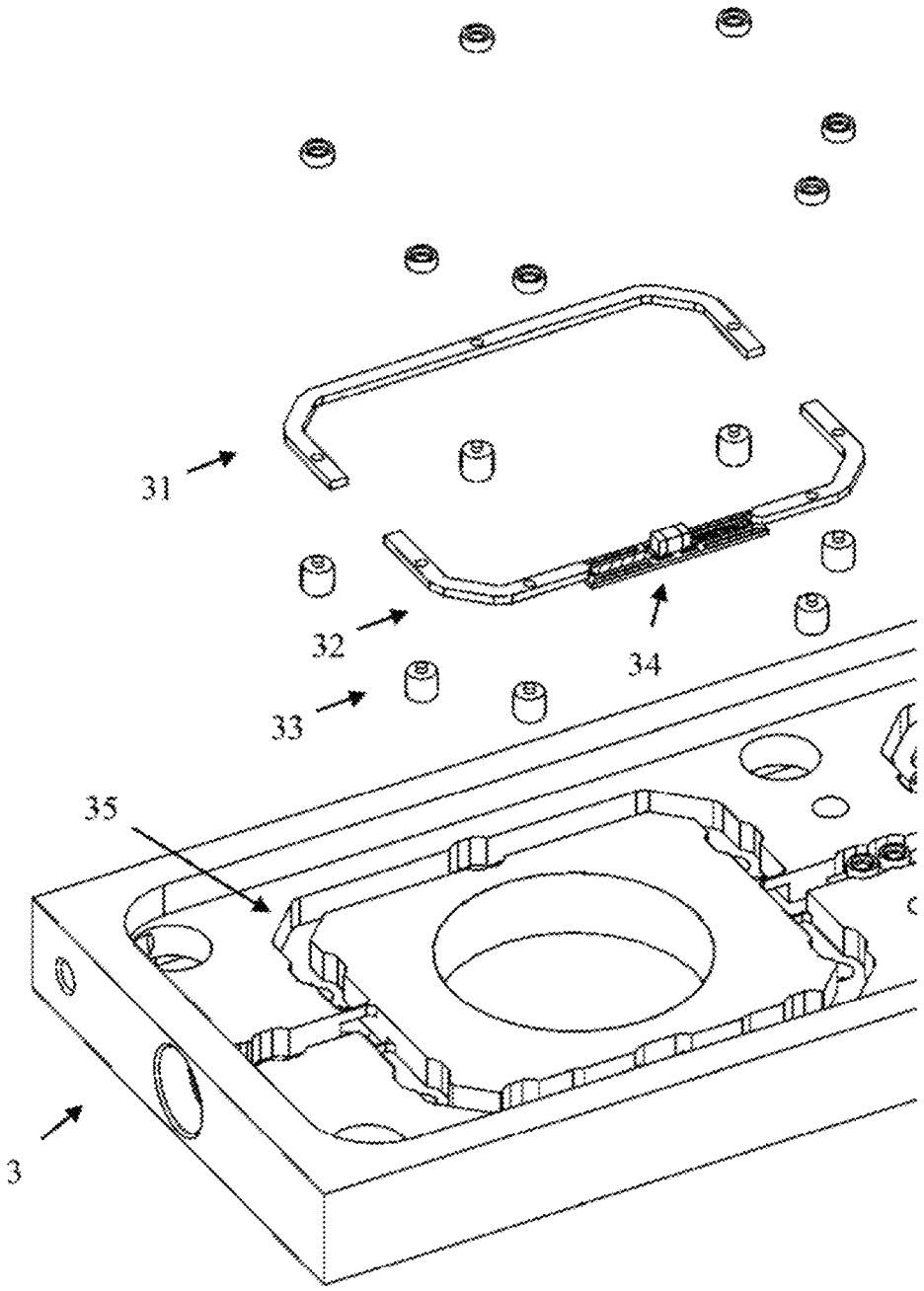
FIG. 7 shows a detailed explosion view of a baseplate of the step attenuator according to an example embodiment of the present invention.

In FIG. 7, a further detail of the baseplate 3 is shown. Here, the strip conductors 31 and 32 are shown in an explosion view with regard to the baseplate 3. It can clearly be seen that the strip conductor 31 forms a through connection between a left side and a right side of the baseplate 3, while the strip conductor 32 forms a connection between the left side and the right side of the baseplate 3 through the electrical element 34. Also, the support elements 33 can easily be seen here. Moreover, this figure clearly shows the strip conductor channel 35, which is machined into the baseplate 3.

Figure 8:
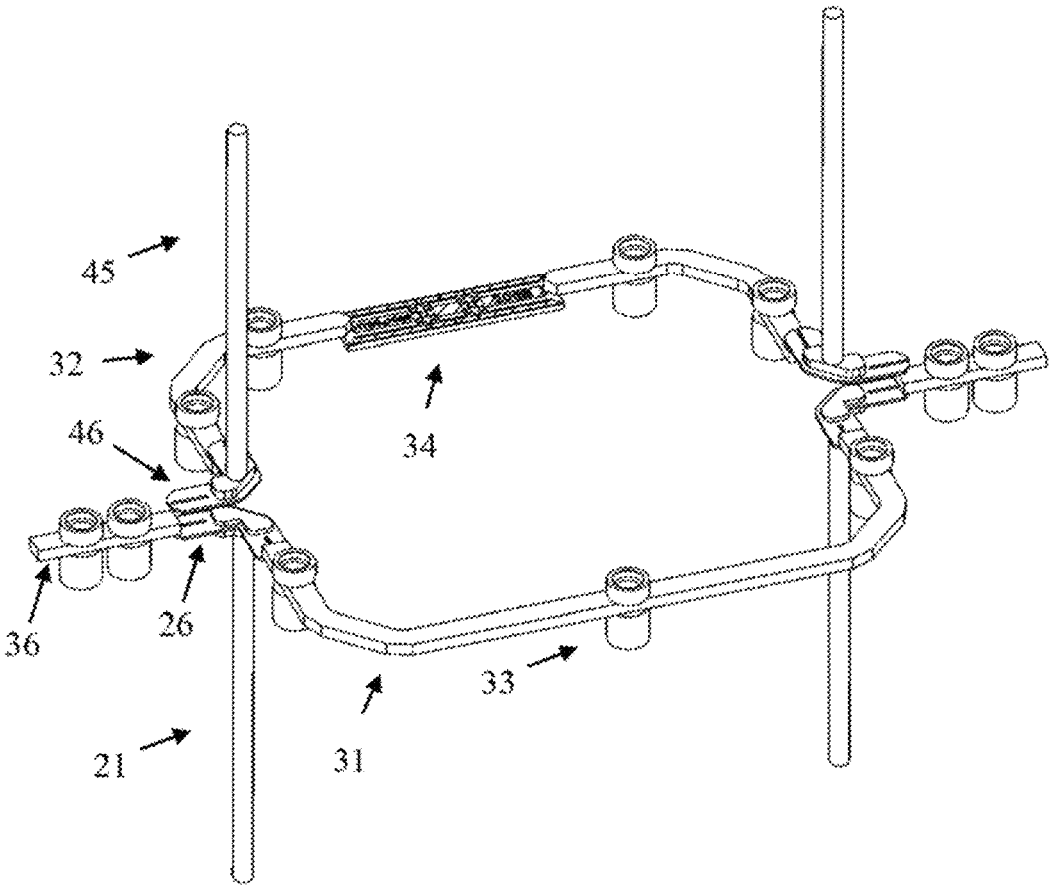
FIG. 8 shows a detailed view of two switches according example embodiments of the present invention.
Figure 9:
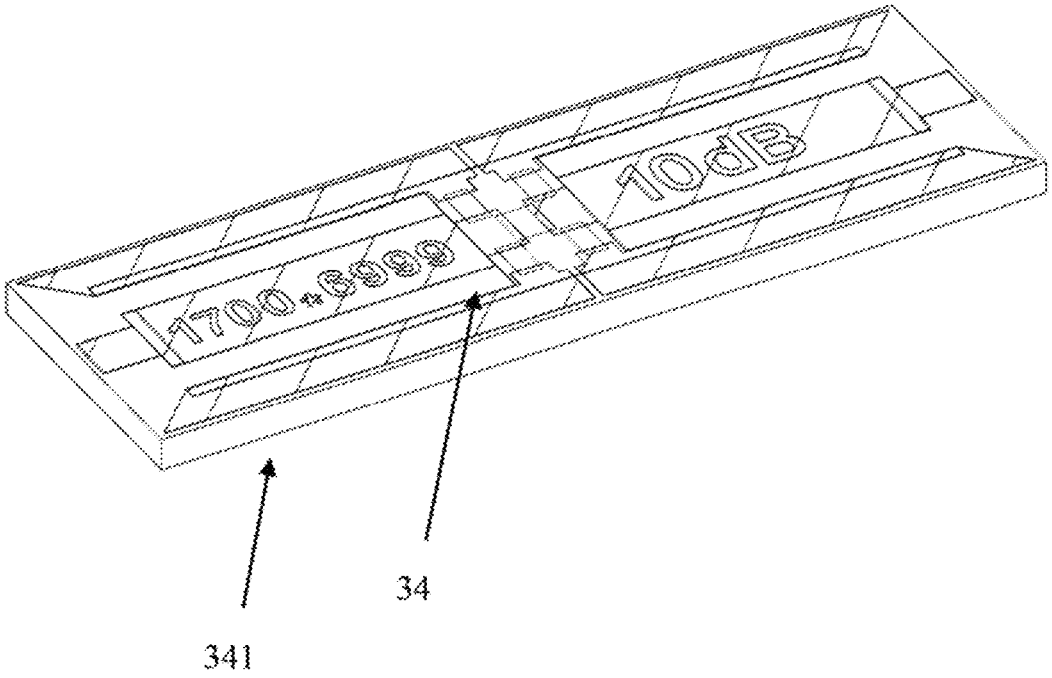
FIG. 9 shows a detailed view of an electrical element according example embodiments of the present invention.

In FIG. 8, a view of two switches according to the first aspect of the invention without the surrounding baseplate 3 and housing 2, 4 is shown. Since the two switches are constructed identically, only the left switch is provided with reference signs.

A first strip conductor 36 forms an input of the switch. The first strip conductor 36 can be connected to the strip conductor 32, which connects the electrical element 34 and alternatively to the strip conductor 31, which forms the through connection as explained earlier.

The switch comprises an upper connecting rod 45, connected to a first switching conductor 46 and a lower connecting rod 21, connected to a second switching conductor 26. The connecting rods 45, 21 are connected to one of the actuators 6*a*-6*d* and are moved simultaneously.

They can be positioned in a first position and in a second position. In the first position shown here, the switching conductor 46 is not in contact with the first strip conductor 36 and the second strip conductor 32. The switching conductor 46 instead is contact with a ground plane, for example the upper housing or the high frequency sealing sheet 22 arranged between the upper housing and the baseplate 3. At the same time, the switching conductors 26 is in contact to the first strip conductor 36 and the third strip conductor 31. The further switch switches in a similar manner. This means that either the second strip conductor 32 or the third strip conductor 31 is connected with the input and output of the respective attenuation stage.

It is important to note here that the switching conductors 26, 46 are orthogonally shaped in the plane of the strip conductors. Also, the first strip conductor 36 is arranged orthogonally with regard to the second strip conductor 32 and the third strip conductor 31. This achieves an advantageous high frequency behavior, since a high frequency coupling to the presently non-switched path is effectively prevented due to the orthogonal nature of the electromagnetic field.

In FIG. 9, a detailed view of an electrical element 34 is shown. The electrical element 34 is arranged on a substrate 341, especially a ceramic substrate. For example a silicon-nitride-substrate can be used. This is advantageous, since such a substrate has a high temperature conductivity allowing for dissipating a high signal power away from the electrical element 34. In order to thermally connect the substrate 341 to the surrounding, it is advantageously soldered or pressure welded or glued, directly onto the surface of the baseplate 3 within the strip conductor channel 35. Since the substrate 341 itself is non-conductive, this does not constitute a short-circuit between the electrical element and the strip conductor channel 35.

Figure 10:
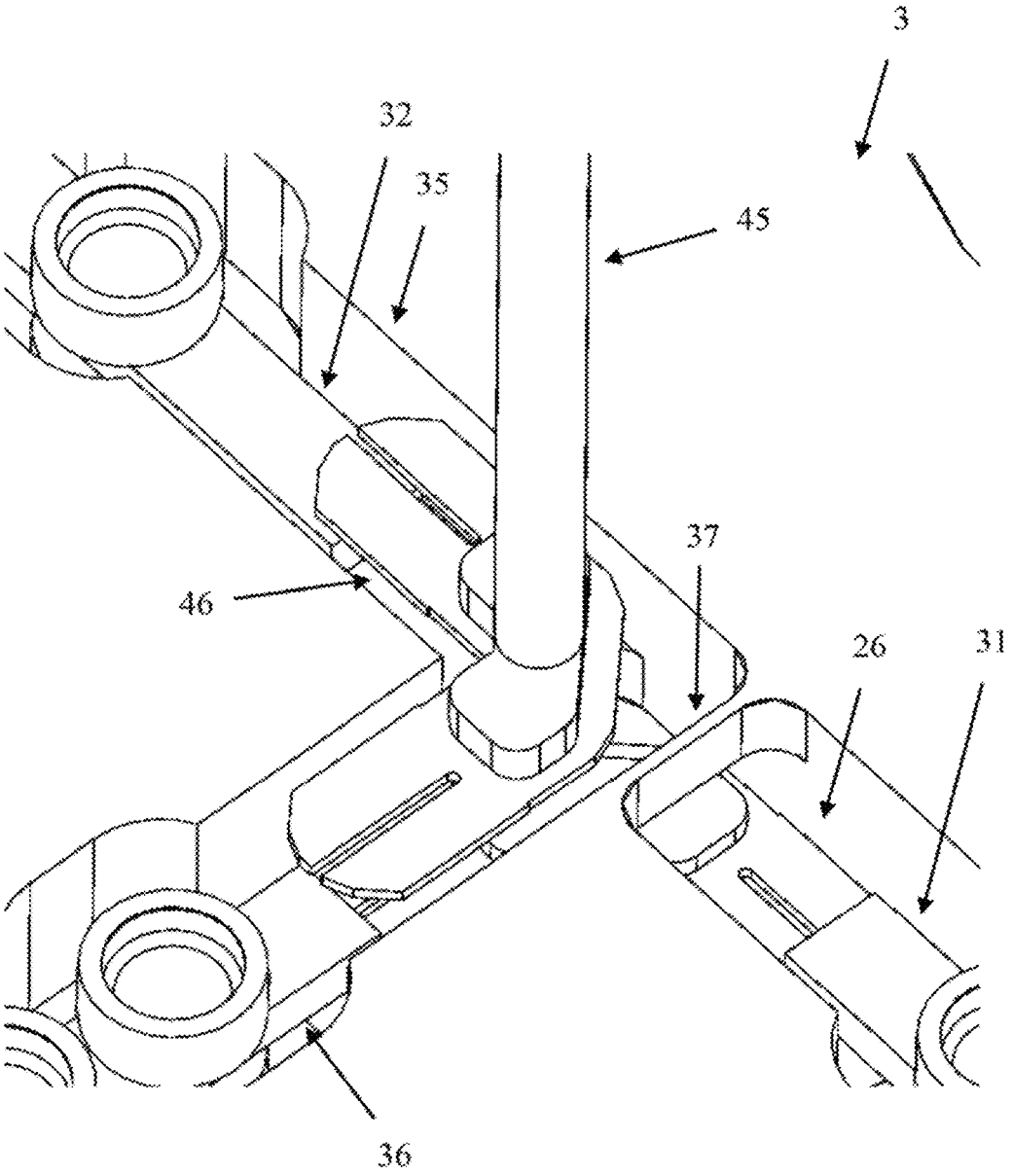
FIG. 10 shows a detailed view of strip conductors and switching conductors in an example switch according example embodiments of the present invention.

In FIG. 10, a three dimensional view of the baseplate 3 surrounding the switching conductors 46, 26 is shown. The baseplate 3 has a strip conductor channel 35 machined into its surface. The first strip conductor 36, the second strip conductor 32 and the third strip conductor 31 are each arranged within this strip conductor channel 35 separated from the strip conductor channel by a gap. The gap has a width of 0.1 mm-0.5 mm, advantageously 0.25 mm. The strip conductors 31, 32, 36 have a width of 0.25 mm-2 mm, advantageously 0.5 mm. The strip conductors 31, 32 and 36 have a thickness of 0.1 mm-0.5 mm, advantageously 0.25 mm.

The switching conductor 46 is connected to the connecting rod 45. The switching conductor 46 in this picture is not in contact with the first strip conductor 36 and the second strip conductor 32. Instead, the switching conductor 26 is in contact with the first strip conductor 36 and the third strip conductor 31. This is though not easily visible in this picture.

It is important to note, that the baseplate 3 has a strip conductor channel wall 37 arranged at the bend of the perpendicular shaped switching conductor 46, separating the switching conductor 46 from the third strip conductor 31. Especially a RF coupling of a signal between the third strip conductor and the switching conductor 46 is thereby prevented. A similar strip conductor channel wall 38 is arranged between the second strip conductor 32 and the switching conductor 26. This can readily be seen in FIG. 13.

Figure 11:
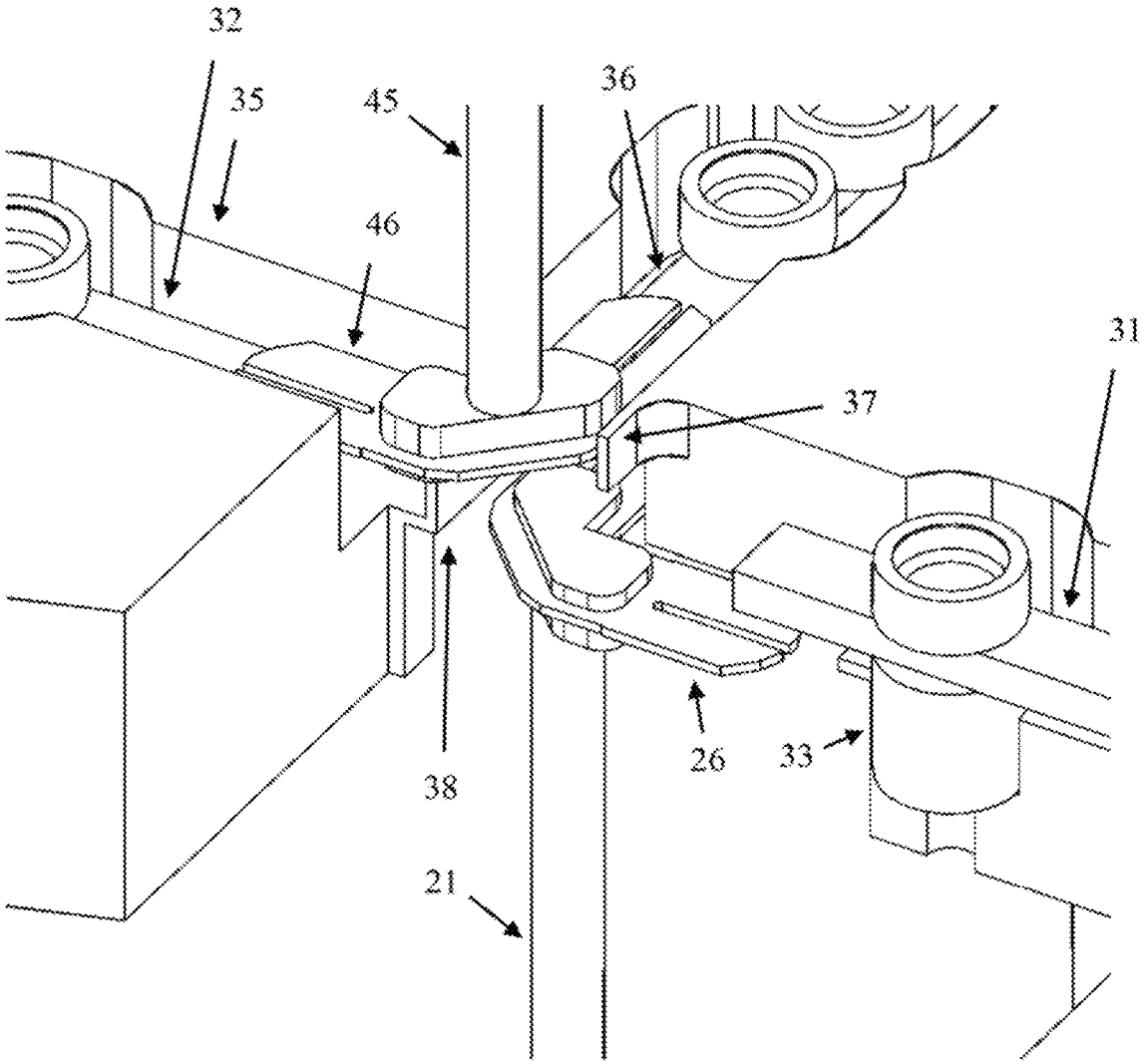
FIG. 11 shows a further detailed view of strip conductors and switching conductors in an example switch according example embodiments of the present invention.
Figure 12:
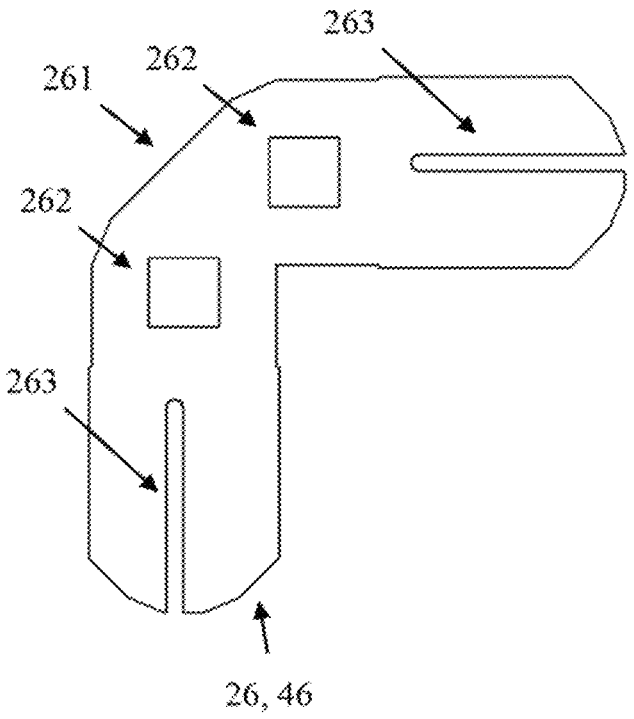
FIG. 12 shows a detailed view of a switching conductor in an example switch according example embodiments of the present invention.

In FIG. 11, a cut-open view corresponding to the view of FIG. 12 is shown. Especially here, the two switching conductors 46, 26 can readily be seen. Also the two high frequency channel walls 37, 38 are easily recognizable.

In FIG. 12 a detailed view of the switching conductors 26, 46 is shown. Each of the switching conductors 26, 46 comprises holes 262 near the bend of its perpendicular shape. These holes 262 are used for connecting the connecting rod 21, 45. Especially, this is done by injection molding the connecting rod 21, 45, for example from a plastic material, wherein the material of the connecting rod 21, 45 flows through the holes 262 and surrounds the switching conductor 26, 46, thereby connecting and holding the switching conductor 26, 46 by the connecting rod 21, 45.

Moreover, the switching conductor 26, 46 can optionally comprise a flattened corner 261 in order to enhance the high frequency behavior.

Furthermore, optionally the switching conductor 26, 46 can comprise slits 263 in its respective distal ends. These slits are useful for increasing the elasticity of the respective tips of the switching conductor 26, 46, thereby decreasing accuracy requirements regarding the exact positioning of the strip conductors 31, 32, 36.

Figure 13:
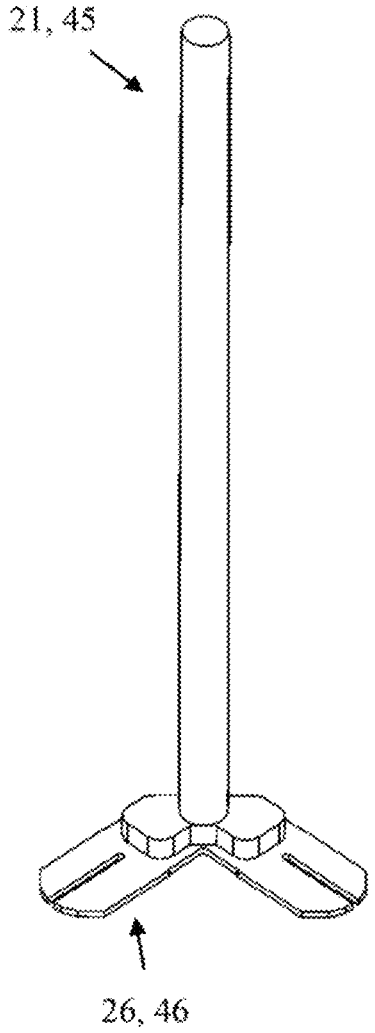
FIG. 13 shows a detailed view of a switching conductor and an according connecting rod in an example switch according example embodiments of the present invention.

In FIG. 13, the switching conductor 26, 46 in connection to the connecting rod 21, 45 is shown.

Figure 14:
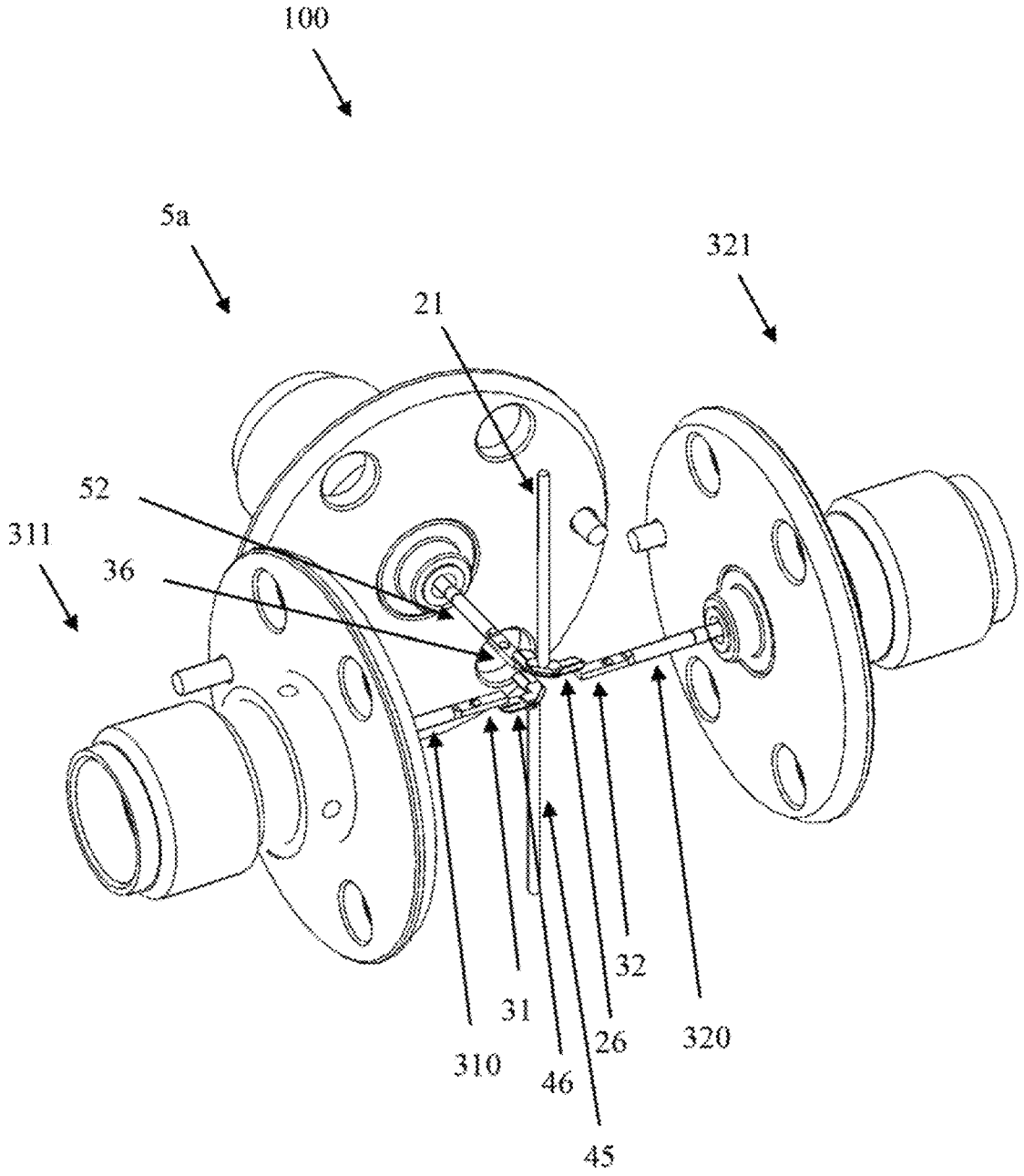
FIG. 14 shows a selector switch according example embodiments of the present invention.

In FIG. 14 a further application of a switch 100 according to the second aspect of the invention is shown. Here, the switch is used in a selector switch, for switching between different high frequency connectors 5*a*, 311, 321. The switch 100 comprises a first high frequency connector 5*a*, a second high frequency connector 321 and a third high frequency connector 311.

The first high frequency connector 5*a* comprises a first inner conductor 52 integrally formed with a first strip conductor 36. The second high frequency connector 321 comprises an inner conductor 320, integrally formed with a second strip conductor 32. The third high frequency connector 311 comprises a third inner conductor 310 integrally formed with a third strip conductor 31.

The first strip conductor 36 is arranged orthogonally with regard to the second strip conductor 32 in the first plane. Within the same first plane, the first strip conductor 36 is arranged orthogonally to the third strip conductor 31.

The inner conductors 52, 320, 310 of the high frequency connectors 5*a*, 321, 311 are each arranged in line with the respectively integrally formed strip conductor 36, 32, 31. Therefore, also the high frequency connectors 5*a*, 321, 311 are arranged in a similar configuration to the respective strip conductor 36, 32, 31. This means that the first high frequency connector 5*a* is arranged orthogonally to the second high frequency connector 321. Also the first high frequency connector 5*a* is arranged orthogonally to the third high frequency connector 311.

The switch 100 moreover comprises a first switching conductor 26 connected to a connecting rod 21 and a second switching conductor 46 connected to a connecting rod 45. The connecting rods 21, 45 are connected to a non-depicted switching actuator, which moves the connecting rods 21, 45 simultaneously and thereby also moves the switching conductors 26, 46 simultaneously. The switching actuator is configured to move the switching conductors 26, 46 between a first position, in which the first switching conductor 26 is in contact to the first strip conductor 36 and the second strip conductor 32, while the second switching conductor 46 is not in contact to any of the strip conductors 36, 32, 31 but instead to a ground plane, and a second position, in which the second switching conductor 46 is in contact to the first strip conductor 36 and the third strip conductor 31, while the first switching conductor 26 is not in contact to any of the strip conductors 36, 32, 31 but instead to a ground plane.

Figure 16:
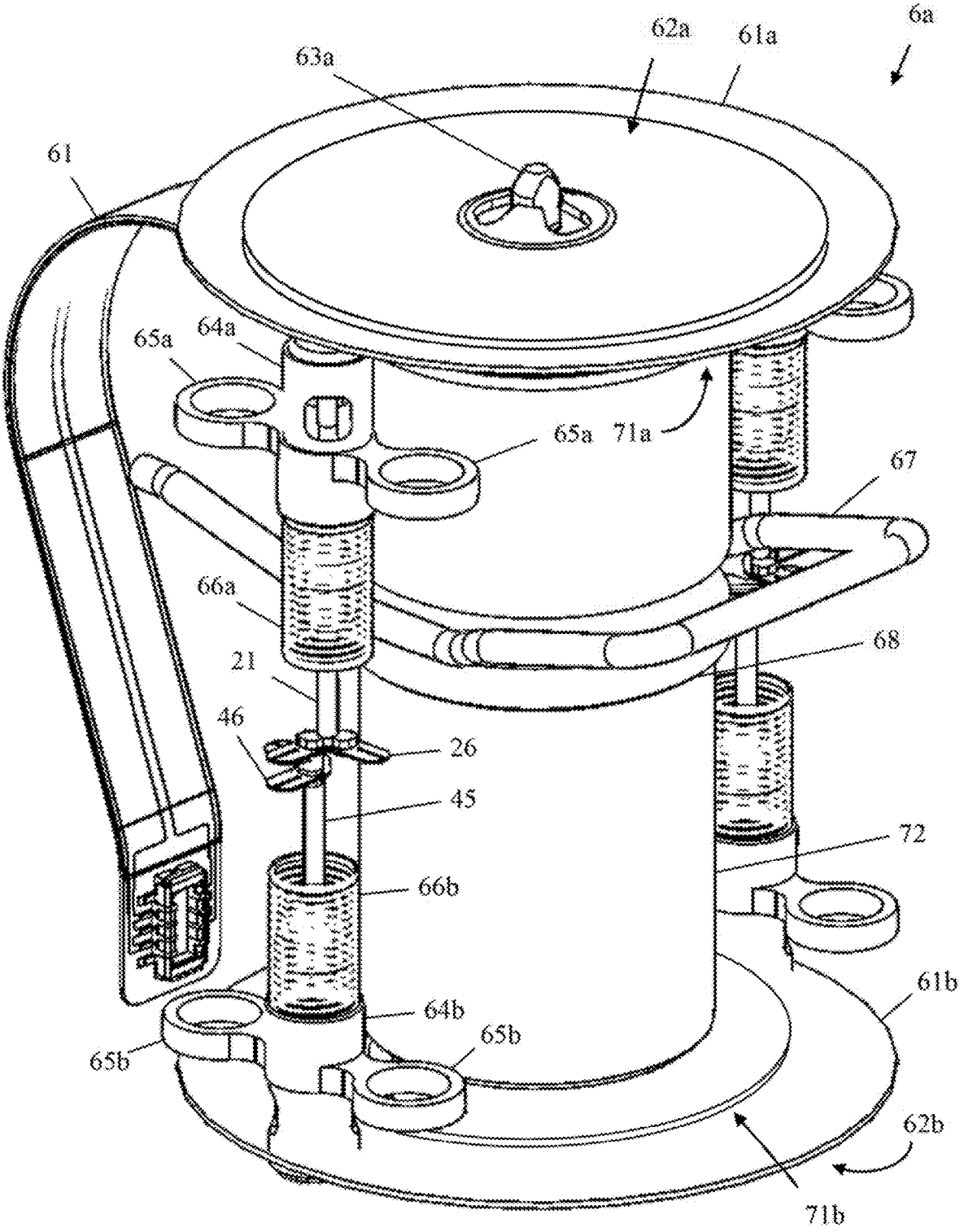
FIG. 16 shows an actuator of an example switch according example embodiments of the present invention.

This means that the first switching conductor 26 in FIG. 16 is lowered onto the first strip conductor 36 and the second strip conductor 32 in the first position, while the second switching conductor 46 is moved downwards away from the strip conductor 36, 32, 31. In the second position, the second switching conductor 46 is moved upwards towards the lower side of the first switching conductor 36 and the third switching conductor 31, while the first switching conductor 26 is moved away from the upper side of the switching conductor 36, 32, 31.

Figure 15:
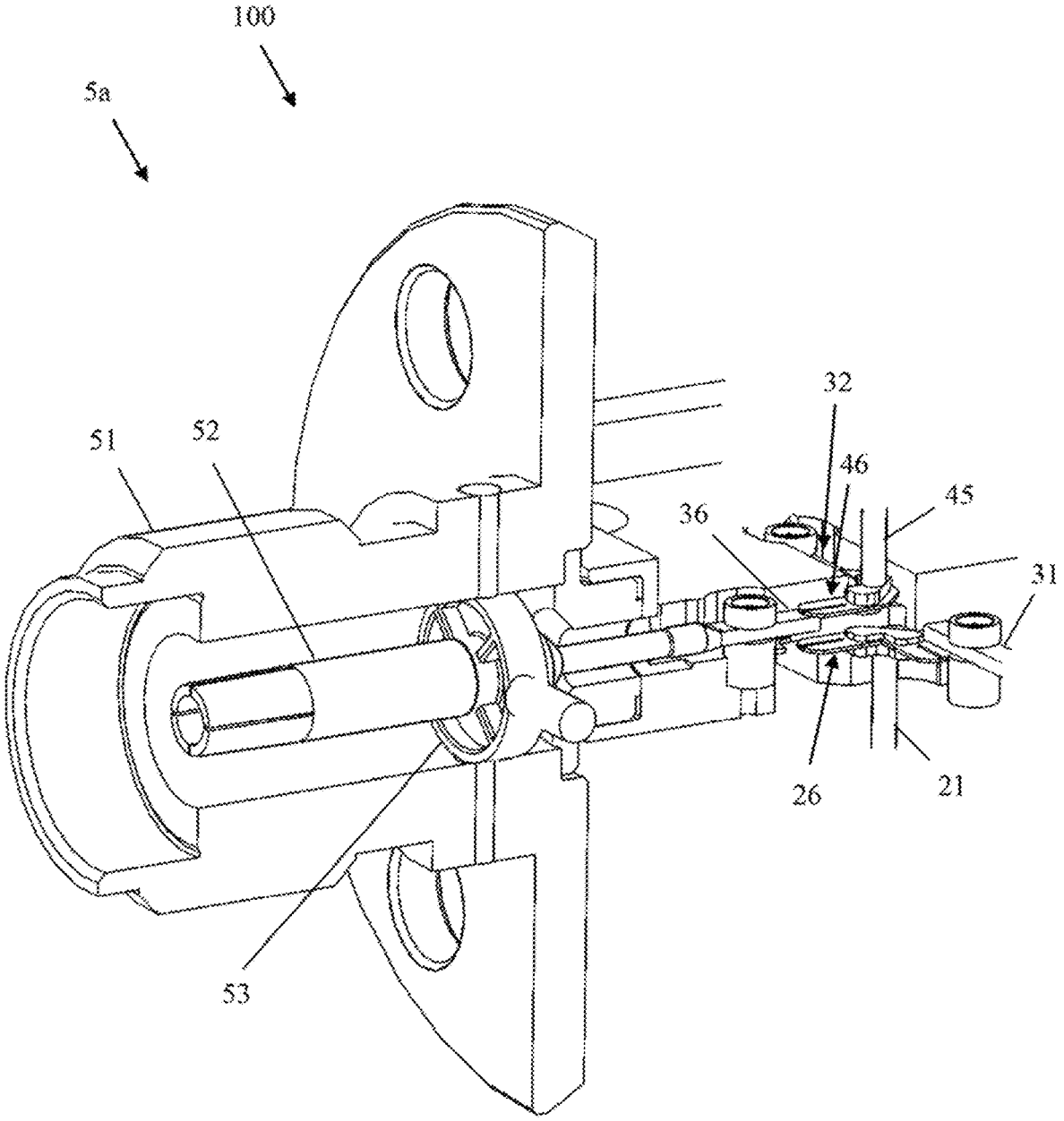
FIG. 15 shows an input situation of a selector switch according example embodiments of the present invention.

In FIG. 15, the input situation of one of the input high frequency connectors 5*a* is shown. The high frequency connector 5*a* comprises an outer conductor 51 and an inner conductor 52. In this example, the conductors 51, 52 form a co-axial connector. Within the high frequency connector 5*a*, a port support 53 is arranged. It holds the inner conductor 52 within the outer conductor 51 in a non-conductive manner. Since the inner conductor 52 is integrally formed with the first strip conductor 36, the port support 53 also holds the first strip conductor 36 in position. On the right side of FIG. 17, the identical components already depicted in FIG. 16 are shown again, but not described in detail, here.

In FIG. 16, a switching actuator 6*a* is depicted in detail. The actuators 6*a*-6*d* are identical to each other.

The actuator 6*a* comprises a ridge 68 and is held in place by a securing spring 67, which locks in the ridge 68 and holds the actuator in its place in the respective hole of the upper housing, lower housing and baseplate.

Moreover, the actuator 6*a* comprises an actuator-element 63*a*, 63*b*, which is moved up and down by the actuator 6*a* between a first position and a second position. The actuator-element 63*a* is connected to an diaphragm-spring-element 61*a*, an absorber plate 62*a* and a stop member 71*a* on the top side of the actuator 6*a* and to a second diaphragm-spring-element 61*b*, an absorber plate 62*b* and a stop member 71*b* on the bottom side of the actuator 6*a*. The actuator-element 63*a* moves a first side of the diaphragm-spring-elements 61*a*, 61*b*, which corresponds to the central part of the respective diaphragm-spring-elements 61*a*, 61*b*. In this example, the diaphragm-spring-elements 61*a*, 61*b* are diaphragm springs. They comprise a number of slits by which the elastic characteristic of the diaphragm springs can be tuned. The slits are preferably formed as helical-spring-recesses.

The absorber-plate 62*a* is placed at the outer surface of the diaphragm-spring-element 61*a*. The further absorber-plate 62*b* (not visible at this figure) is placed at the outer surface of the diaphragm-spring-element 61*b*. Each of the absorber-plates 62*a*, 62*b* are in plane contact with its corresponding diaphragm-spring-element 61*a*, 61*b*. The absorber-plates 62*a*, 62*b* are made of a low friction material. This material is chosen with respect to a low abrasion of the diaphragm-spring-element 61*a*, 61*b*.

The second aspect of the selection of the material is the ability of converting the kinetic energy of the diaphragm-spring-element 61*a*, 61*b* into thermal energy. This is aimed by the residual friction between the diaphragm-spring-element 61*a*, 61*b* and the absorber plate 62*a*, 62*b*. A material having such properties is a Polyimid, a PTFE (polytetrafluoroethylene) or a polyoxymethylene. The selection of the material is not limited to the mentioned materials. Additionally, the kinetic energy while switching is converted into thermal energy by deforming the absorber-plate 62*a*, 62*b*.

The stop-member 71*a* (not visible at this figure) is placed in contact to the surface of the diaphragm-spring-element

61*a* directed to the actuator. The further stop-member 71*b* is placed with contact to the inner surface of the diaphragm-spring-element 61*b*. The stop-member 71*a*, 71*b* is a stiff, non-elastic plate. A suitable material is a metal (e.g. steel, German silver, aluminum) or a fiber-reinforced-plastic. Using a stiff plate as a stop-member 71*a*, 71*b* results in a reduction of a negative overshoot of the diaphragm-spring-element 61*a*, 61*b*.

The diaphragm-spring-element 61*a*, 61*b* tends to keep its position cause by mass inertia. When the diaphragm-spring-element 61*a*, 61*b* is accelerate, the no-driven part of the diaphragm-spring-element 61*a*, 61*b* keeps its position for a short while before following the acceleration. This leads to a swing around the driven part of the diaphragm-spring-element 61*a*, 61*b*. The stop-member 71*a*, 71*b* suppresses such a movement in a direction towards the motor 72 of the actuator. As it can be seen, a faster acting of the actuator is provided by the stop-member 71*a*, 71*b*, as the elastic moment of the diaphragm-spring-element 61*a*, 61*b* is nearly eliminated in direction to the motor 72 of the actuator.

Connected to a second side of the diaphragm-spring-elements 61*a*, 61*b* are shafts 64*a*, 64*b*, which are connected to the connecting rods 21, 45, which in turn are connected to the switching conductors 26, 46. The shafts 64*a*, 64*b* are moreover connected to springs 66*a*, 66*b*, which on their respective other side are in contact with the outer side of the baseplate, exerting an elastic force, forcing the respectively connected switching conductors 26, 46 away from each other.

The shafts 64*a*, 64*b* are moreover supplied with loops 65*a*, 65*b*, which are used for preventing the shafts 64*a*, 64*b* from rotating.

The actuator 6*a* is provided with shafts 64*a*, 64*b*, connecting rods 21, 45 and switching conductors 26, 46 on a left side and on a right side and therefore are symmetrical. They are adapted to move the switches according to the first aspect of the invention simultaneously, as also depicted in FIG. 7 and FIG. 10. Therefore, one actuator 6*a* is used for two switches and therefore for one attenuation stage.

The actuator 6*a* is supplied with a switching current through a cable 61.

Figure 17:
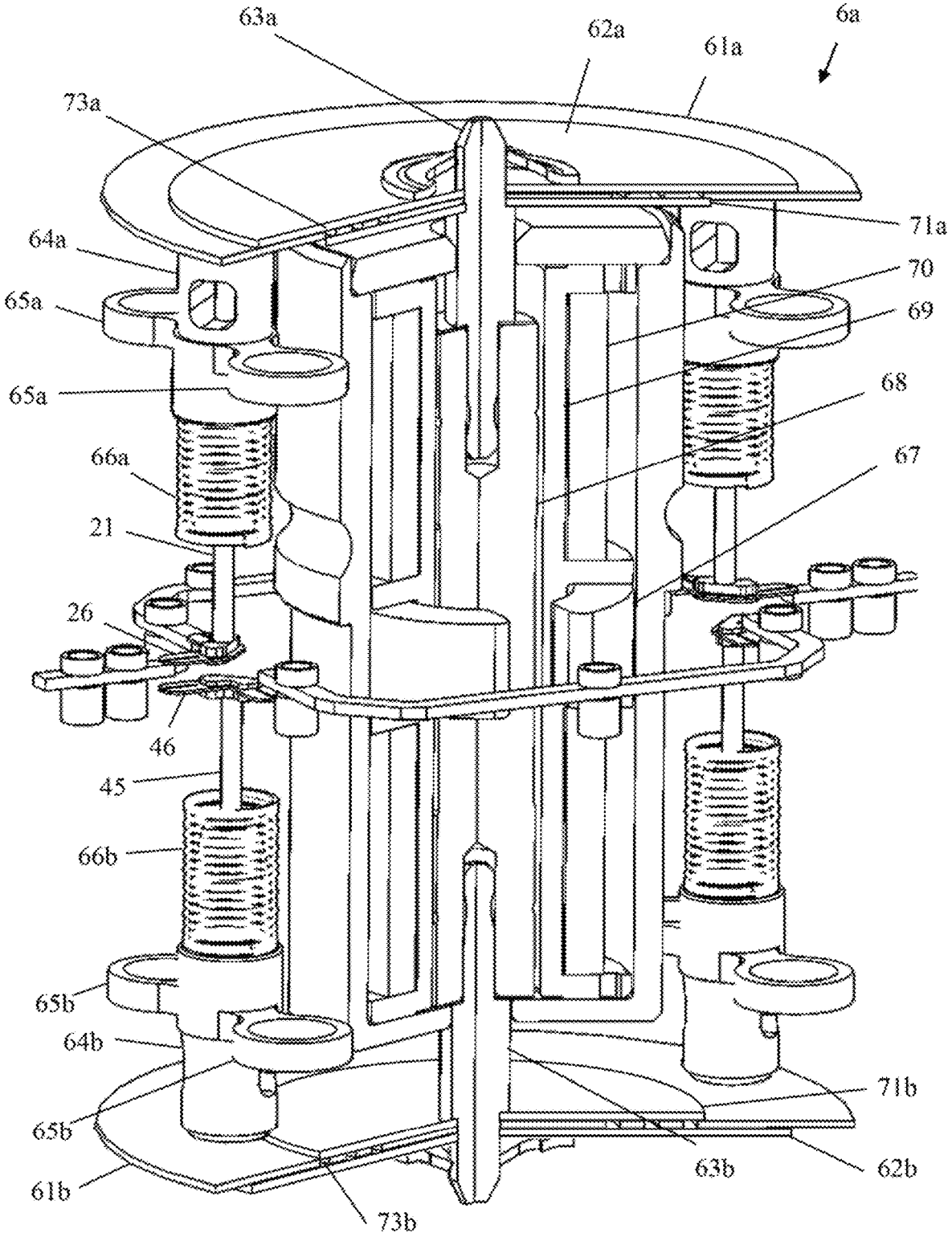
FIG. 17 shows a cut-open view of an actuator in an example switch according example embodiments of the present invention.
Figure 18:
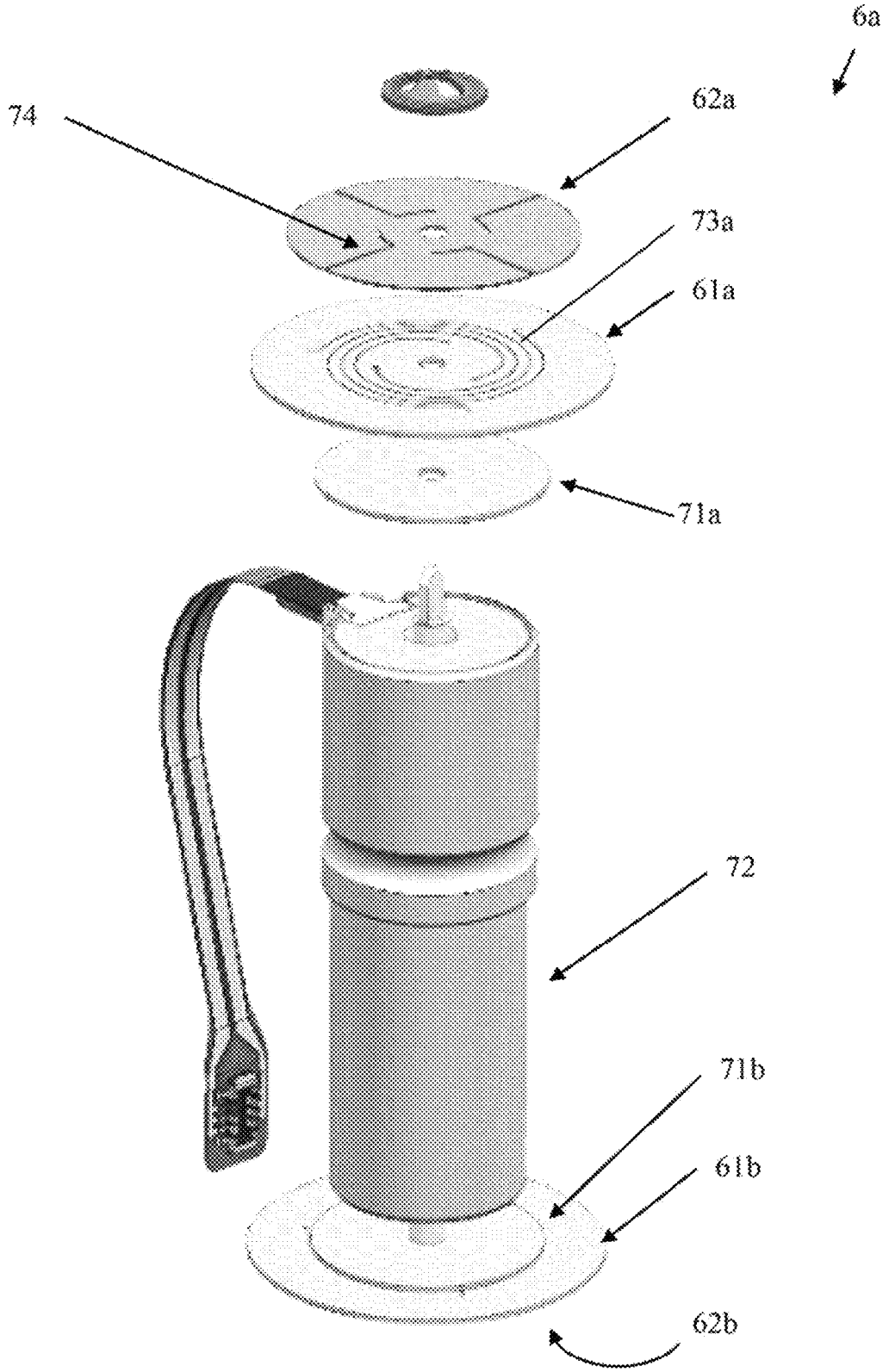
FIG. 18 shows an explosion view of an actuator of an example switch according example embodiments of the present invention.

In FIG. 17, a cut-open view of the actuator 6*a* of FIG. 18 is shown. The elements already described along FIG. 16 are not described again here. The absorber-plate 62*b* and the stop-member 71*a* describer as not visible in FIG. 16 can be clearly seen in FIG. 17. The actuator 6*a* comprises the before-described actuator-element 63*a*, 63*b*, which is formed in conjunction with a core 68. The actuator-element 63*a*, 63*b* moves together with the core 68 within a housing 69.

Arranged within the housing 69 and fixed to the housing is a permanent magnet 67. Moreover an electromagnet 70 is arranged fixed to the housing 69. The core 68 along with the actuator-element 63*a*, 63*b* is therefore movable with regard to the permanent magnet 67 and the electromagnet 70.

The permanent magnet 67 makes sure, that there is always a magnetic force pulling the actuator-element 63*a*, 63*b* either towards a first switching position or a second switching position. This means that the core 68 is either in contact with an upper side of the housing 69 or a lower side of the housing 69. The magnetic force is in equilibrium in a central position, but this position is not stable. Therefore, the actuator is bi-stable in the two switching positions. By running a switching current through the electromagnet 70, the magnetic force of the permanent magnet 67 is overpowered, thereby allowing a switching between the two stable states.

In FIG. 17, moreover in addition to the depiction in FIG. 16, the strip conductors are shown.

Furthermore, the preferred dimension of the absorber-plate 62*a*, 62*b* with respect to the helical-spring-recess 73*a*, 73*b* is shown in FIG. 17. The diameter of the absorber-plate 62*a*, 62*b* is equal or bigger than the outer diameter of the helical-spring-recess 73*a*, 73*b* of the diaphragm-spring-element 61*a*, 61*b*. This construction is suitable for avoiding an interlock between the absorber-plate 62*a*, 62*b* and the diaphragm-spring-element 61*a*, 61*b*.

The dimension of the stop-member 71*a*, 71*b* with respect to the helical-spring-recess 73*a*, 73*b* is also shown in FIG. 17. It can be seen that the diameter of the stop-member 71*a*, 71*b* is equal or bigger than the outer diameter of the helical-spring-recess 73*a*, 73*b* of the diaphragm-spring-element 61*a*, 61*b*. Therefore, there is an interlock between the absorber-plate 62*a*, 62*b* and the diaphragm-spring-element 61*a*, 61*b*.

In FIG. 18, an explosion view the switching actuator 6*a* is depicted in detail. The actuators 6*a*-6*d* are identical to each other. The elements already described along FIG. 16 and FIG. 17 are not described again here. The absorber-plate 62*a* exemplarily shown in FIG. 18 comprises additional slots 74. These slots 74 are placed radially in the absorber plate 62*a*, 62*b*. A helical form of the slots 74 can also beneficial used. The design of the slots 74 are not limited to these examples. The geometry of the slots 74 can be adapted to the considerations of the desired absorbing characteristics.

The invention is not limited to the examples. The invention discussed above can be applied to many different types of switches, attenuation stages and step attenuators. Especially the type of actuator is not to be understood as limiting. The characteristics of the exemplary embodiments can be used in any combination.

Although the present invention and its advantages have been described in detail, it should be understood, that various changes, substitutions and alterations can be made herein without departing from the spirit and scope of the invention as defined by the appended claims.

What is claimed is:

1. A selector-switch, comprising:

a force-controlled-switch, including a diaphragm spring element an absorber-plate, a first conductor connected to a first terminal, a second conductor connected to a second terminal, and a third conductor connected to a third terminal; and wherein the absorber-plate is configured to absorb kinetic energy of the force-controlled-switch, in particular a part of the diaphragm-spring-element's kinetic energy.

2. The selector-switch of claim 1, wherein the absorber-plate comprises at least one slot.

3. The selector-switch of claim 1, wherein the absorber-plate is formed of a friction stable material, preferably of Polyimide or polytetrafluoroethylene (PTFE).

4. The selector-switch of claim 1, wherein the absorber-plate has a thickness of 0.1-1 mm, preferably of 0.4-0.7 mm.

5. A radio-frequency-relay comprising at least one selector-switch according to claim 1, wherein:

a first conductor of the at least one selector-switch forms an input-terminal of the radio-frequency-relay; and a second conductor of the at least one selector-switch forms an output-terminal of the radio-frequency-relay.

6. A step-attenuator, comprising at least two of the selector switch of claim 1, wherein:

a first conductor of a first of the at least two selector-switches forms an input terminal of the step attenuator;

a first conductor of a second of the at least two selector-switches forms an output terminal of the step-attenuator or an input-terminal of a further of the at least two selector-switches;

a second conductor of the first of the at least two selector-switches is connected to a first terminal of an electrical element;

a second conductor of the second of the at least two selector-switches is connected to a second terminal of the electrical element; and a third conductor of the first of the at least two selector-switches is connected to a third conductor of the second of the at least two selector-switches.

7. The selector-switch of claim 1, wherein the absorber-plate is arranged in plane contact to the diaphragm-spring-element.

8. The selector-switch of claim 7, wherein the diaphragm-spring-element and the absorber-plate form a sandwich.

9. The selector-switch of claim 1, wherein the diaphragm-spring-element is a circular shaped plate comprising at least one helical-spring-recess.

10. The selector-switch of claim 9, wherein the surface of the absorber-plate is equal or greater than the outer dimension of the helical-spring-recess.

11. The selector-switch of claim 1, comprising an additional stop-member.

12. The selector-switch of claim 11, wherein the diaphragm-spring-element is arranged between the absorber-element and the stop-member.

13. The selector-switch of claim 11, wherein the stop-member is formed of a rigid material, preferably of metal or fiber-reinforced-plastic.

14. The selector-switch of claim 11, wherein the stop-member has a thickness of 0.3-1 mm, preferably 0.5-0.8 mm.

* * * * *